United States Patent [19]

Häusser

[11] Patent Number: 4,559,879

[45] Date of Patent: Dec. 24, 1985

[54] HEIGHT ADJUSTABLE WORK PLATE

[75] Inventor: Horst Häusser, Rudersberg, Fed. Rep. of Germany

[73] Assignee: Horst Häusser Metallwaren GmbH, Rudersberg, Fed. Rep. of Germany

[21] Appl. No.: 422,352

[22] Filed: Sep. 23, 1982

[30] Foreign Application Priority Data

Dec. 31, 1981 [DE] Fed. Rep. of Germany ... 8138223[U]

[51] Int. Cl.[4] ..... A47B 9/02

[52] U.S. Cl. ..... 108/136; 108/146

[58] Field of Search ..... 108/136, 146, 147; 74/110, 147, 41

[56] References Cited

U.S. PATENT DOCUMENTS

| | | | |
|---|---|---|---|
| 2,805,580 | 9/1957 | Kane | 74/41 X |
| 2,819,042 | 1/1958 | Feucht | 173/147 |
| 3,327,985 | 6/1967 | Levit et al. | 108/146 X |
| 3,444,830 | 5/1969 | Doetsch | 108/136 |
| 3,606,021 | 9/1971 | Roels | 108/136 X |
| 4,119,044 | 10/1978 | Hines | 108/146 X |
| 4,130,069 | 12/1978 | Evans et al. | 108/136 |

*Primary Examiner*—William E. Lyddane
*Assistant Examiner*—Peter A. Aschenbrenner
*Attorney, Agent, or Firm*—Burmeister, York, Palmatier, Hamby & Jones

[57] ABSTRACT

A height adjustable work plate, particularly for sewing machine tables, including a carriage supporting the work plate and being slidably guided on a vertical frame structure, wherein the work plate is assisted by a pneumatic spring provided at its upper end with a pulley over which a rope is trained, one end of the rope being attached to the frame and the other end to the carriage.

13 Claims, 3 Drawing Figures

HEIGHT ADJUSTABLE WORK PLATE

FIELD OF THE INVENTION

This invention relates to a height adjustable work plate, particularly for sewing machine tables, including a carriage supporting the work plate and slidably guided on a vertical frame structure.

BACKGROUND OF THE INVENTION

Especially in cases work plates are supporting equipment which needs to be adjusted as to height, depending on the prevailing operating conditions, the problem of balancing the weight of the equipment arises in order to make height adjustments of the work plate without undue exertion, while at the same time keeping the space requirements for the structural counterbalance elements at a minimum. In particular, sewing machine tables or cabinets require a work plate which can be vertically adjusted to enable the sewing machine on the plate to be lowered completely below the table top, and further, to move the work plate into two different operating positions in which the arm of the sewing machine is either at the level of the table top or is freely disposed above the table top. In carrying out these operations, it is neccessary to counterbalance the considerable weight of the sewing machine so that the height of the work plate can be adjusted effortlessly by the usually female user of the sewing machine. It is desirable for the sewing machine to take up only as much space in the cabinet or table as is absolutely necessary and leave enough room for sewing materials without making the sewing machine table or cabinet excessively big. However, there is usually not enough room left, neither beneath nor above the work plate, to accommodate the structures necessary for weight balancing.

SUMMARY OF THE INVENTION

It is therefore the object of the present invention to provide a height adjustable work plate of the foregoing type so that but a minimum amount of space will be required for the mounting of the work plate and, especially, for the weight balancing structure. In addition, the work plate and its supporting framework is to be of an uncomplicated construction and at the same time ensure a largely playfree guidance of the workplate along the column.

This is accomplished according to the invention in that the work plate is assisted by a pneumatic spring provided at its upper end with a pulley over which a rope is trained. One end of the rope is attachod to the supporting framework and the other end to the carriage.

A characteristic feature of a pneumatic spring is a large stroke of an approximately uniform force. The novel use of a pneumatic spring in combination with a rope and pulley assembly has the result that the stroke of the pneumatic spring is doubled, so that it is possible to arrange the pneumatic spring in the setup so that it will not occupy a space larger than the space between the lower edge of the carriage in its lowermost position and the upper edge of the carriage in its uppermost position. Consequently, the invention provides an extremely space saving arrangement which simultaneously is of a simple design and affords a nearly constant weight balancing.

In a preferred embodiment of the invention, the supporting framework comprises a column disposed at the rear edge of the work plate. The pneumatic spring and the rope are disposed at the side of the column which faces away from the work plate. The column is C-shaped in cross section, and at its corners is provided with slanting guiding surfaces for rollers mounted on the carriage. This arrangement has the particular advantage that the pneumatic spring located at the side of the column facing away from the work plate may be disposed inside the C-shaped column so that it will not take up any space at all outside the column. Moreover, an open C-section is itself slightly resilient, so that a resilient engagement of the guiding surfaces by the associated rollers is achieved which ensures a completely play-free mounting of the work plate. Also in this instance, outstanding results are obtained with extremely simple means.

A resilient cooperation between the column and the carriage may also be achieved by providing the carriage with a substantially U-shaped member in the form of a stirrup or clamp. Attached to the side portions of the U-shaped member are rollers, and the mid section of the U-shaped member has arms attached thereto for carrying the work plate. Hence, the side portions of the U-shaped member permit a certain amount of resiliency of the attached rollers, and this again promotes a playfree mounting of the work plate. In this particular construction, a column having a rigid cross section would also be suitable for interaction with the rollers. However, it is particularly advantageous when a carriage provided with a substantially U-shaped clamping member is combined for interaction with a column approximately C-shaped in cross section, and the ends of the side portions of the U-shaped member are connected by à tie rod. The tie rod imparts a bias to the rollers, fastened to the side portions of the U-shaped member, with respect to the column, such that the carriage is able to move playfree on the column, without having to worry about narrow manufacturing tolerances; permissible pressure forces between carriage and column are not exceeded.

When using a tie rod, the rope may be attached to a retaining member hung over the tie rod. Again, this simple measure yields an uncomplicated effective structure having a high level of operational safety.

According to one embodiment of the invention, the side of the column facing the work plate may be provided with latch means which cooperate with a movable member on the carriage. Since the column has a high degree of stability, the latch means may conveniently take the form of cutouts in projections formed on the column. In this instance, the movable locking member may take the form of a stirrup attached to a pivotable rod. In particular, it is possible to dispose the rod with the stirrup attached thereto rotatably between the two side portions of the U-shaped member of the carriage. Once again, highly simplified means result in a very stable arrangement that can be handled with ease and affords a safe latching of the work plate in various operating positions as well as an easy unlatching.

The invention will be described in further detail with reference to one embodiment illustrated in the drawings. The features disclosed in the specification and the drawings may be utilized in the various embodiments of the invention either individually or in any combination.

DETAILED DESCRIPTION OF AN ILLUSTRATIVE EMBODIMENT

Figure 1:
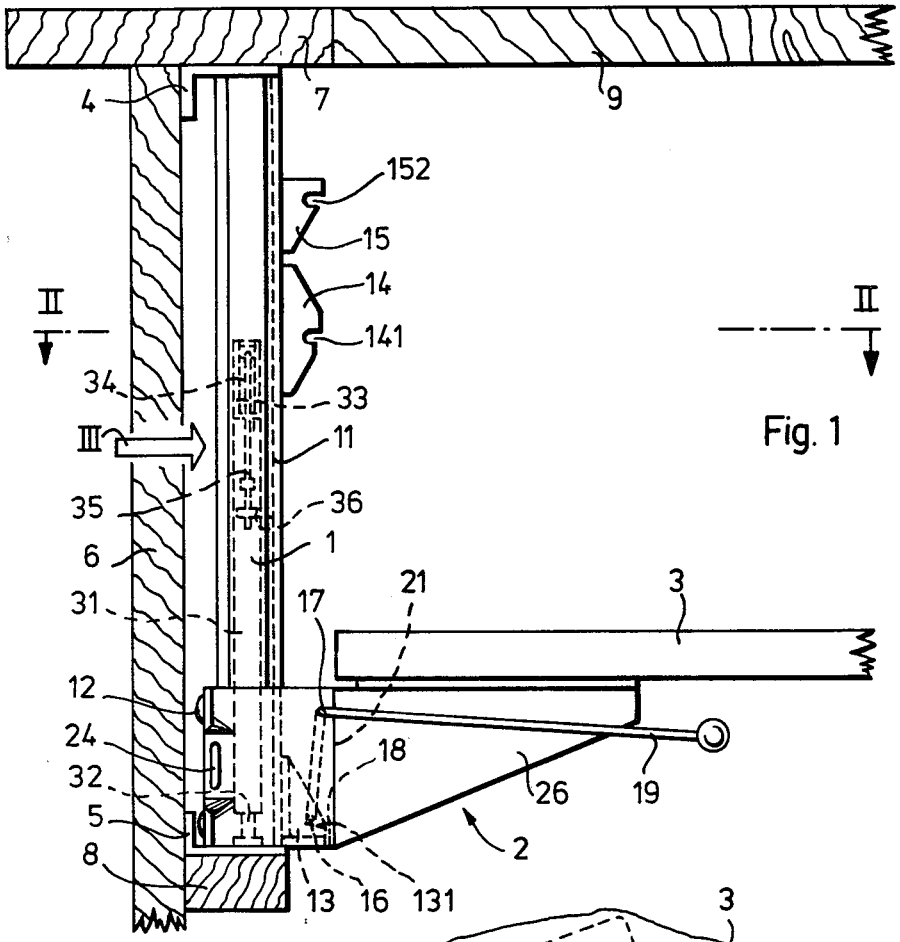
FIG. 1 is a side elevational view of parts of a sewing machine table having an height adjustable work plate.
Figure 2:
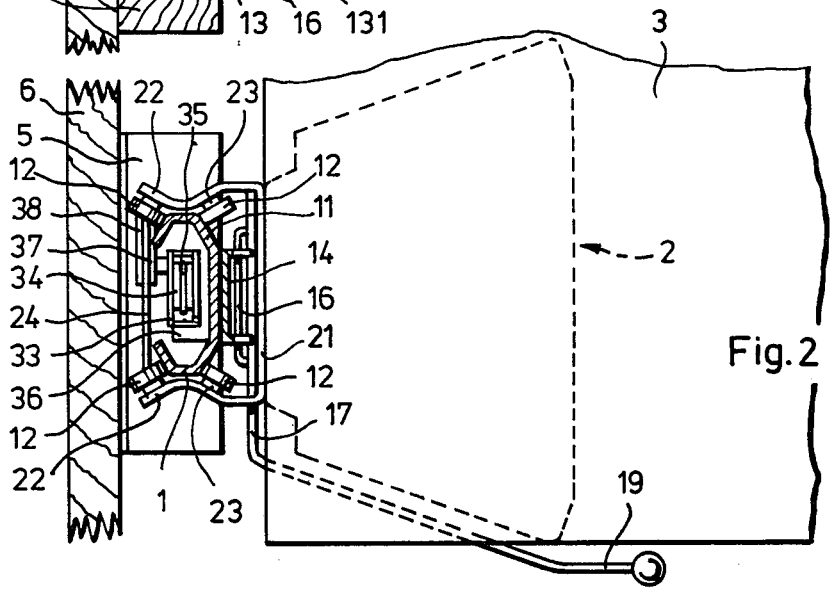
FIG. 2 is a sectional view along the line II—II of FIG. 1.
Figure 3:
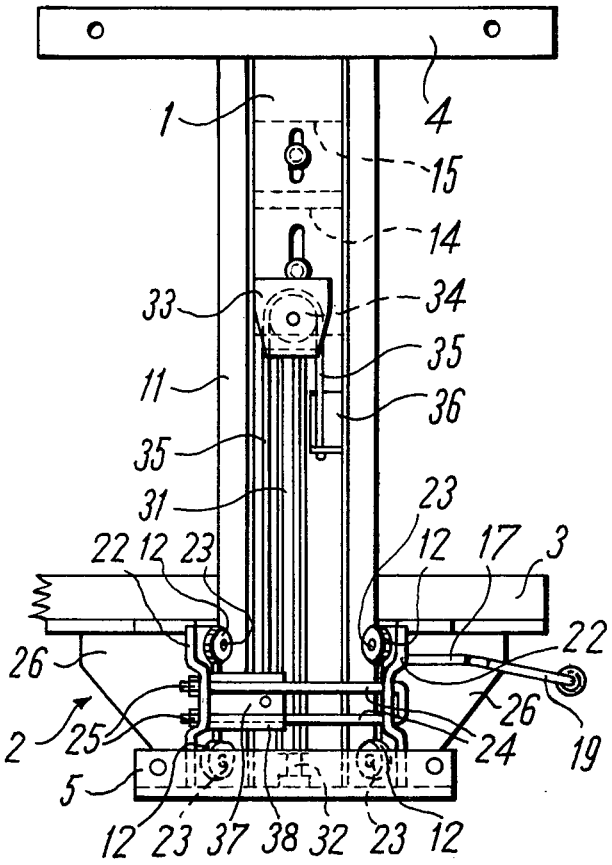
FIG. 3 shows the height adjustable work plate as viewed in the direction of the arrow III in FIG. 1.

The height adjustable work plate assembly illustrated in the drawings comprises a vertical column 1 and a carriage 2 vertically movable on the column 1 and supporting the work plate 3. In the illustrated embodiment, the column 1 is secured to the back 6 of the sewing machine table by angular brackets 4 and 5 in such a manner that the upper bracket 4 bears against the underside of the table top 7 and the lower bracket 5 is positioned on a bar 8 attached to the back 6. The table top 7 is provided with an opening fit to receive the work plate 3. The opening can be closed by an insertable plate or board 9, as it is shown in FIG. 1.

The column 1 is approximately C-shaped in cross section and has guiding surfaces 11 disposed diagonally with respect to the lateral surfaces, for rollers 12 mounted on the carriage 2. The column 1 is so orientied that the C-shape opens onto the rear wall 6 of the sewing machine table and thus faces away from the work plate 3.

The carriage 2 is provided with a substantially U-shaped member or clamp 21 for holding the column 1 between its side portions or legs 22. The rollers 12 are attached to the legs 22 and are journaled on pins 23. The free ends of the legs or side portions 22 are connected by a tie rod 24 in the form of a length of wire, which is inserted with its flanged side portions, which are normal to the side portions 22 of the U-shaped member, into appropriate holes in the side portions 22 and is secured therein by lock nuts 25.

Thus, the tie rod 24 braces with its mid section and also by the lock nuts 25 against the side portions 22 of the U-shaped member 21. In this manner it is possible to tighten the side portions 22 of the U-shaped clamp toward each other so that the rollers 12 can be applied with a certain bias to the guiding surfaces 11 provided at the corners of the column 1. The column 1 itself, by virtue of its C-shaped cross section, is resilient to a certain extent, so that a playfree setting up with a predetermined bias is possible, which ensures an absolutely playfree movement of the carriage 2 on the column 1.

The U-shaped member 21 as part of the carriage 2 is provided on the side of its mid section facing away from the column 1 with arms 26 for supporting the work plate 3. The work plate 3 is adapted to be locked in three different elevations by latch means 13, 14 and 15 provided on the column 1. In the lowermost position shown in FIG. 1, the work plate 3 is spaced from the table top 7 a distance such that a sewing machine on the work plate 3 can be lowered to below the table top 7 and the opening in the table top 7 can be closed by inserting the plate 9.

The middle latch 14 defines the position for a free arm sewing machine supported on the work plate 3, wherein the upper surface of the free arm lies in the plane of the table top 7.

In the position defined by the uppermost latch 15, the work plate 3 itself is at the level of the table top 7.

The latch means 13, 14 and 15 are formed by brackets having cutouts 131, 141, 151 which are engaged by a locking member in the form of the mid section 16 of a wire clamp. The side portions of the wire clamp are fastened to a pivotable rod 17 which is journaled between the side portions 22 of the U-shaped member 21. A compression spring 18 arranged between the mid section 16 of the wire clamp and the mid section of the U-shaped member 21 on the carriage 2 urges the mid section 16 of the wire clamp into engagement with the latch bracket. An arm 19, constituted in the illustrated embodiment simply by an angular extension of the rod 17, permits the rod 17 to be pivoted and thus effects the unlatching of the mid section 16 from the latch bracket.

Especially in cases where the work plate 3 is supporting a piece of equipment having a considerable weight, such as a sewing machine, a height adjustment of the work plate 3 is possible without excessive effort only when provisions for counterbalancing the weight of the equipment have been made. In the illustrated embodiment, the weight balancing is accomplished by a pneumatic spring 31 disposed in the interior of the column 1. The pneumatic spring 31 bears with the end of its piston rod 32 against the angle 5 provided at the bottom end of the column 1 and at its top end is provided with a pulley 34 mounted in a bearing bracket 33. A rope 35 trained over the pulley 34 is with one end attached to an angle iron 36 which is secured to the inner surface of the column 1. The other end of the rope 35 is attached to a plate-shaped retaining member 37 which is hooked with its flanged edge 38 over the lower leg of the tie rod 24 and braces with its upper end against the upper leg of the tie rod 24. The pneumatic spring 31 thus acts with one half of its pressure force on the rope 35 fastened to the carriage 2 by way of the retaining member 37, tending to pull the carriage 2 up. On the other hand, the length of movement of the pulley 34 is only one half the distance covered by the carriage 2.

This transmission ratio of the motion of the pulley 34 makes it possible to use a pneumatic spring 31, the stroke of which amounts to only one half of the length of the adjustment movement executed by the work plate 3. Since the total length of a pneumatic spring needs to be only slightly greater than twice its stroke, the length of the column 1 for accommodating the pneumatic spring 31 is sufficient, because the column 1 must be longer than the adjusting distance of the work plate 3 by the amount of the vertical dimension of the carriage 2. It will be understood that by applying the rope and pulley principle, an even greater transmission ratio can be obtained so that the use of a pneumatic spring in combination with a pulley assembly is still possible even if only a fraction of the length of the total adjusting distance of the work plate is available for accommodating the pneumatic spring.

It will be appreciated that the invention is not limited to the disclosed embodiment, but that modifications may be made which are within the scope of the invention. In particular, a height adjustable work plate in accordance with the invention may not only be used for sewing machine tables or cabinets, but may also be used to advantage for a variety of other equipment. Furthermore, the invention is not restricted to the use of a single column in the back of the work plate, but structures for supporting and guiding the work plate are conceivable which include a plurality of such columns of which some may be located at the lateral edges of the work plate. Pneumatic spring operated pulleys may be employed to ensure a parallel guiding of the work plate.

I claim:

1. A height adjustable work support for a sewing machine table, comprising a vertical guide column which is generally C-shaped in cross section and has an open side facing rearwardly, said column comprising corner portions having diagonally extending guiding surfaces, a generally horizontal work plate projecting forwardly from said column, a vertically movable carriage supporting said work plate, said carriage having a plurality of rollers rotatably mounted thereon and in rolling engagement with said guiding surfaces of said column for guiding said carriage for vertical height adjusting movement along said column, a variable length pneumatic spring disposed rearwardly of said column and having a lower portion connected to said column rearwardly thereof, said pneumatic spring having an upper portion with a pulley mounted thereon, a rope trained over said pulley and having first and second end portions extending downwardly therefrom, said first end portion of said rope being connected to said column rearwardly thereof, said second end portion of said rope being connected to said carriage rearwardly of said column, and latching means operative between said carriage and said column for selectively latching said carriage in a plurality of height adjustments, said pneumatic spring having a nearly constant force exerting characteristic throughout the range of length variation of said pneumatic spring, whereby said carriage is counterbalanced by the force of said pneumatic spring while the range of height adjusting movement of said carriage is twice the range of length variation of said pneumatic spring.

2. A height adjustable work support according to claim 1, said carriage including a generally U-shaped member having side portions on which said rollers are rotatably mounted, said U-shaped member partially embracing said column.

3. A height adjustable work support according to claim 2, said column of generally C-shaped cross section having a rearwardly opening hollow space therein, said pneumatic spring and said rope being disposed in said hollow space.

4. A height adjustable work support according to claim 3, said side portions of said U-shaped member having rear end portions, said carriage having a tie rod connected between said rear end portions of said side portions.

5. A height adjustable work support according to claim 4, including means for connecting said second end portion of said rope to said tie rod.

6. A height adjustable work support according to claim 5, said latching means including a plurality of latching elements on said column, a manually movable latching member on said carriage and selectively engageable with said latching elements, and resilient means for biasing said latching member toward said latching elements.

7. A height adjustable work support according to claim 6, said latching elements comprising projections on said column and having latching cutouts therein, said movable latching member comprising a rod pivotally mounted on said carriage and having a stirrup portion selectively movable into latching engagement with said cutouts.

8. A height adjustable work support according to claim 6, said latching elements comprising projections on said column and having latching cutouts in said projections, said movable latching member comprising a rod pivotally mounted on said side portions of said U-shaped member of said carriage, said rod of said latching member having a stirrup portion selectively movable into latching engagement with said latching cutouts.

9. A height adjustable work support for a sewing machine table, comprising a vertical guide structure, a substantially horizontal work plate, a carriage supporting said work plate and having guidable means engaging said vertical guide structure and guided for vertical movement relative thereto, latching means operative between said carriage and said vertical guide structure for latching said carriage in a plurality of height adjustments relative to said vertical guide structure, a pneumatic spring of a variable length and having a nearly constant force exerting characteristic throughout the range of variation in the length of said spring, said pneumatic spring having a lower portion connected to said vertical guide structure, said pneumatic spring having an upper portion with a pulley thereon, and a rope trained over said pulley and having first and second end portions extending downwardly therefrom, said first end portion of said rope being connected to said guide structure while said second end portion is connected to said carriage, whereby said carriage is counterbalanced by said pneumatic spring while the range of height adjustment of said carriage is twice the range of length variation of said pneumatic spring, said vertical guide structure comprising a column which is generally C-shaped in cross section and includes corner portions with diagonally extending guiding surfaces, said carriage having a plurality of rollers mounted on said guidable means of said carriage and in rolling engagement with said guiding surfaces, said guidable means of said carriage comprising a substantially U-shaped member having side portions on which said rollers are rotatably mounted.

10. A height adjustable work support according to claim 9, said U-shaped member partially embracing said column, said side portions of said U-shaped member having rear ends, said carriage comprising a tie rod connected between said rear ends and disposed rearwardly of said column.

11. A height adjustable work support according to claim 10, including means for connecting the second end portion of said rope to said tie rod.

12. A height adjustable work support according to claim 9, said latching means comprising a plurality of projections on said column and having latching cutouts therein, a movable latching member comprising a rod pivotally mounted on said side portions of said U-shaped member, said rod having a sitrrup portion selectively movable into latching engagement with said cutouts, and resilient means for biasing said rod in a direction to move said stirrup portion into latching engagement with said cutouts.

13. A height adjustable work support for a sewing machine table, comprising a vertical guide structure, a substantially horizontal work plate, a carriage supporting said work plate and having guidable means engaging said vertical guide structure and guided for vertical movement relative thereto, latching means operative between said carriage and said vertical guide structure for latching said carriage in a plurality of height adjustments relative to said vertical guide structure, a pneumatic spring of a variable length and having a nearly constant force exerting characteristic throughout the range of variation in the length of said spring, said pneumatic spring having a lower portion connected to said vertical guide structure, said pneumatic spring having an upper portion with a pulley thereon, and a rope trained over said pulley and having first and second end portions extending downwardly therefrom, said first end portion of said rope being connected to said guide structure while said second end portion is connected to said carriage, whereby said carriage is counterbalanced by said pneumatic spring while the range of height adjustment of said carriage is twice the range of length variation of said pneumatic spring, said latching means comprising a plurality of vertically spaced latching elements mounted on said vertical guide structure, and a manually movable latching member movably mounted on said carriage and selectively movable into latching engagement with said latching elements, said latching means including resilient means for resiliently biasing said movable latching member toward said latching elements, said latching elements comprising projections mounted on said vertical guide structure and having latching cutouts therein, said movable latching member comprising a rod pivotably mounted on said carriage and having a stirrup portion for selectively engaging said cutouts.

* * * * *